US008056891B2

(12) United States Patent
Facey et al.

(10) Patent No.: US 8,056,891 B2
(45) Date of Patent: Nov. 15, 2011

(54) PALLETISED LOADS OF CONTAINERS

(75) Inventors: Hugh David Facey, Sheffield (GB); Derek Boaler, Sheffield (GB); John Makin, South Yorkshire (GB); Neil Clarke, Rotherham (GB)

(73) Assignee: Loadhog Limited (GB)

( * ) Notice: Subject to any disclaimer, the term of this patent is extended or adjusted under 35 U.S.C. 154(b) by 952 days.

(21) Appl. No.: 12/063,113

(22) PCT Filed: Mar. 27, 2007

(86) PCT No.: PCT/GB2007/001106

§ 371 (c)(1),
(2), (4) Date: Feb. 7, 2008

(87) PCT Pub. No.: WO2007/132141

PCT Pub. Date: Nov. 22, 2007

(65) Prior Publication Data

US 2008/0272348 A1 Nov. 6, 2008

(30) Foreign Application Priority Data

May 12, 2006 (GB) ..... 0609452.8

(51) Int. Cl.
*B23Q 3/00* (2006.01)

(52) U.S. Cl. ..... 269/310; 269/111; 269/316; 108/57.33; 108/57.12; 206/597

(58) Field of Classification Search ..... 16/225, 16/226; 53/399; 254/414, 262, 246, 225, 254/231, 10.5; 410/46, 35; 222/562; 108/136, 108/57.33, 57.3, 57.26, 57.21, 57.2, 57.17, 108/57.16, 57.12, 53.1; 428/177; 206/597; 269/111; *B32B 3/02; B65D 19/00, 19/38, 61/00, 71/00*

See application file for complete search history.

(56) References Cited

U.S. PATENT DOCUMENTS 3,957,285 A * 5/1976 Schlaeger ..... 410/100
4,295,568 A * 10/1981 Orpen ..... 206/597
4,492,153 A * 1/1985 Grabowski ..... 99/460

(Continued)

FOREIGN PATENT DOCUMENTS

GB 713 019 8/1954

(Continued)

*Primary Examiner* — Lee D Wilson
*Assistant Examiner* — Jamal Daniel
(74) *Attorney, Agent, or Firm* — Clark Hill PLC

(57) ABSTRACT

A device for use on palletized loads of containers for maintaining tension in vertical strapping comprises a rectangle (20) having outer dimensions commensurate with the dimensions of a pallet or dolly on which. containers are to be stacked in layers, each side of the rectangle comprising upper and lower leaves (21L, 22L) diverging from hinge means at the inner edge of the side, the lower leaves (22L) of all four sides being disposed in a common plane, and spring means (23) urging the outer edges of the upper and lower leaves apart. In one form of the device (20) the sides of a pair of rectangular frames (21, 22) constitute the upper and lower leaves (21L, 22L) and conical coil compression springs (23) are provided between the frames to urge them apart, tethering means (25, 27) adjacent the inner edges of the frames being such as to form the hinge means between the leaves, while tethering means (24, 26) adjacent the outer edges of the frames limit the extent to which the leaves (21L, 22L) are caused to diverge. In other forms the spring means is integral with the hinge means.

13 Claims, 8 Drawing Sheets

U.S. PATENT DOCUMENTS

| | | | | |
|---|---|---|---|---|
| 6,926,258 | B1 * | 8/2005 | Sowa et al. | 254/231 |
| 2008/0014037 | A1 * | 1/2008 | Facey et al. | 410/35 |
| 2008/0260055 | A1 * | 10/2008 | Kim et al. | 375/260 |
| 2009/0020452 | A1 * | 1/2009 | Facey et al. | 206/597 |
| 2009/0223856 | A1 * | 9/2009 | Facey et al. | 206/597 |

FOREIGN PATENT DOCUMENTS

| | | | |
|---|---|---|---|
| GB | 2 291 850 | A | 2/1996 |
| GB | 2 418 663 | A | 5/2006 |
| WO | 2006/032864 | A1 | 3/2006 |

* cited by examiner

PALLETISED LOADS OF CONTAINERS

RELATED/PRIORITY APPLICATION

This application is a National Phase filing regarding International Application No. PCT/GB2007/001106, filed on Mar. 27, 2007. International Application No. PCT/GB2007/001106 relies upon British Application No. GB 0609452.8, filed on May 12, 2006, for priority.

This invention relates to devices for maintaining tension in vertical strapping on palletised loads of containers, such as bottles or cans, in which the upright containers are stacked automatically in layers on a pallet (or a dolly) with slip sheets (also known as layer pads) e.g. of polypropylene of the order of 2.0 to 4.0 mm thickness, between the layers, and also one below the bottom layer, each successive slip sheet being placed on top of a layer of containers and each successive layer of containers being pushed laterally en masse or lowered from above on to the preceding slip sheet, the completed stack being topped-off by a slip sheet and a rigid board which is subjected to a downward loading, e.g. of 2 to 3 tonnes, to compact the layers and slip sheets whilst strapping is automatically applied vertically between the pallet and the board, across under the platform of the pallet (or dolly) and across the top of the board. The board is usually formed by four lengths of wood, e.g. each 97 mm wide and 17 mm thick, joined together to form a rectangle having outside dimensions commensurate with the dimensions of the pallet.

Upon arrival at the point of use, the vertical strapping is cut off, the rigid board and top slip sheet removed, and the height of the stack is adjusted so that each layer of containers can be pushed laterally en masse off the slip sheet below on to, e.g., a conveyor feeding a bottling or canning line.

Because the strapping, after securing ends together before removing the downward loading, is of finite length, any subsequent settling of the stack, e.g. due to variation in bottle height, e.g. plus or minus up to 1.0 mm, and/or vibration and/or stretching of the strapping, particularly arising from expansion due to temperature rise subsequent to the strapping operation results in loss of tension in the strapping that can lead to instability of the stack, especially as vibration of the palletised load during transporting can cause 'bottle-walking' (or 'can-walking') from within the confines of the slip sheets, hereinafter referred to simply as 'walking', with disastrous results, especially breaking of bottles, but also denting of cans.

It is, therefore, common practice to apply strapping horizontally around each layer of containers, but there still remains a tendency to 'walking' of a layer en masse from palletised loads, especially from loads disposed over wheels of a truck where vibration is particularly intense. It is also known to place on top of each layer a cardboard cap with sides to embrace the outermost containers adjacent their tops, as another attempt to prevent 'walking'. Any sudden braking and/or impact, such as hitting kerbs or pot-holes, causes rapid destabilisation of the stack following any leading row of containers falling over the adjacent edge of the slip sheet below.

GB-A-2 418 663 describes and claims a device for use in place of the board previously described comprising a pair of rectangular frames each of outer dimensions commensurate with the dimensions of a pallet or dolly on which containers are to be stacked in layers, springs being provided between the frames to urge them apart, and tethering means being provided to limit separation of the frames, whereby, after removal of the downward loading applied whilst vertical strapping takes place, the spring urge between the frames is available to maintain tension in the vertical strapping.

One object of the present invention is to improve the performance of the device described above.

Another object is to provide a simpler construction of device for the purpose aforesaid, with consequent saving in material and manufacturing costs.

According to the present invention, a device for use in place of the board previously described comprises a rectangle having outer dimensions commensurate with the dimensions of a pallet or dolly on which containers are to be stacked in layers, each side of the rectangle comprising upper and lower leaves diverging from hinge means at the inner edge of the side, the lower leaves of all four sides being disposed in a common plane, and spring means urging the outer edges of the upper and lower leaves apart.

The effect of this construction is improved distribution of the loading applied by the lower leaves to the outer rows of containers in a stack.

As regards the device in GB-A-2 418 663 this can be adapted by providing adjacent the inner edges of the frames tethering means limiting separation to such an extent that the effect is to form hinge means between the frames, whereby the springs between the frames urge the outer edges of the frames apart to an extent limited by tethering means adjacent those edges.

However, according to the other aspect of the invention, the spring means is integral with the hinge means; thus avoiding need for tethering means between the leaves.

Such a simplified device may have each of its sides formed from spring steel strip bent longitudinally to form hinge means between upper and lower leaves, with the lower leaves in a common plane and welded together at the corners of the rectangle, and with outer edge portions of the leaves (i.e. remote from the hinge means) along each side of the rectangle bent towards each other into overlapping relationship, to prevent ingress of debris preventing proper use of the device.

Tethering means between the outer edge portions of the leaves may, however, be preferable, being advantageous in enabling pre-loading of the spring means, affording greater effectiveness in maintaining tension in vertical strapping of a load on a pallet. Thus, the extreme edges of the overlapping outer edge portions may be bent so as to hook together.

Alternatively, separate spring means each consisting of upper and lower arms diverging from an arcuate or coiled hinge portion may be encased in plastics material forming upper and lower leaves with co-moulded outer edge portions extending towards each other into overlapping relationship, to prevent ingress of debris preventing proper use of the device, all the lower leaves of plastics material being in a common plane and connected together at the corners of the rectangle, e.g. by welding of mitred ends of the leaves or by snap-fitting means enabling the device to be disassembled for replacement of any damaged sides or for cannibalisation of damaged devices. Thus a plurality of spring means may be assembled by spaced location of their hinge portions along a plastics rod or tube adapted for integration in between the plastics leaves, and the ends of the rods or tubes may be connected together by sockets or spigots on corner pieces.

Tethering means may be provided in the form of snap-engaging projections along the overlapping outer edge portions of the plastics leaves.

A number of embodiments of the invention will now be described, by way of example only, with reference to the accompanying drawings, in which:—

Figure 1:
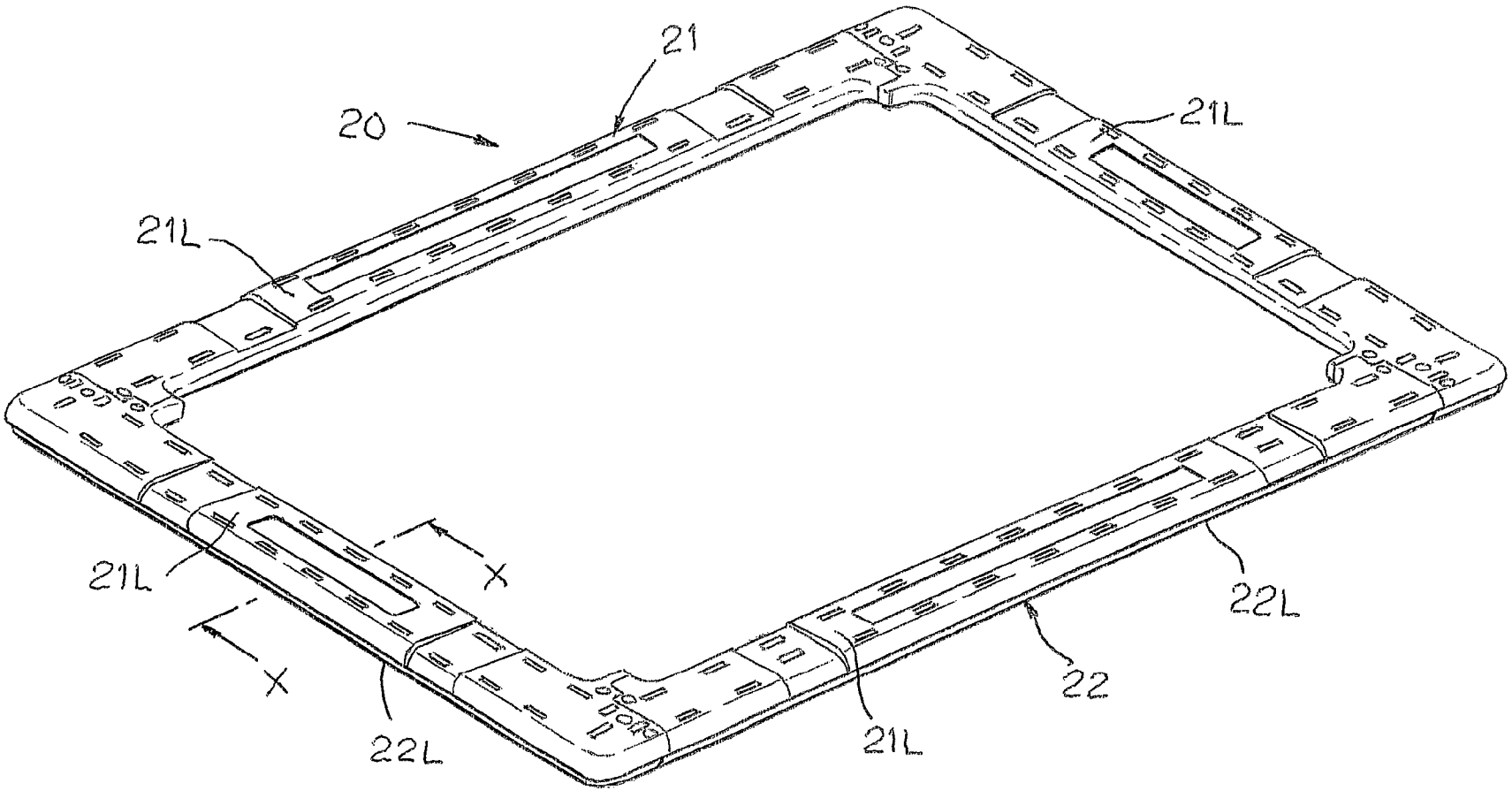
FIG. 1 is a small scale isometric view of a device as in GB-A-2 418 663 adapted to conform to the present invention.
Figure 2:
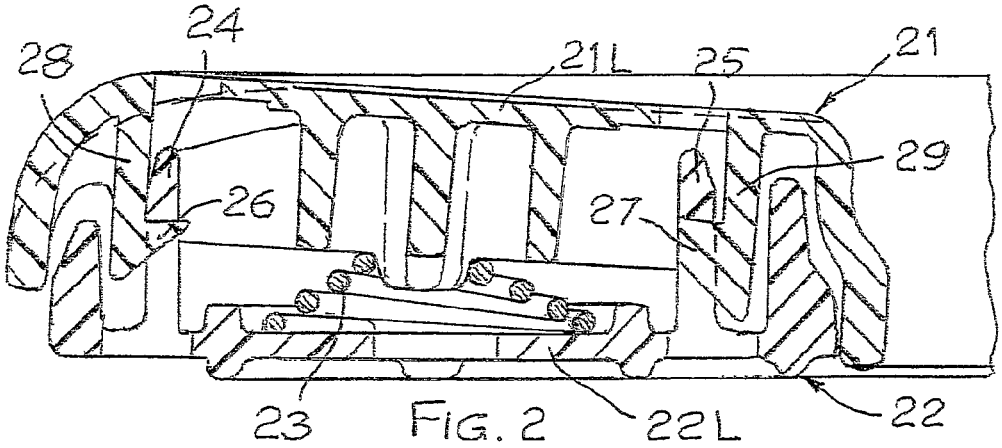
FIG. 2 is an enlarged vertical section taken generally from the line X-X of FIG. 1 showing the upper and lower frames (or leaves) in as-assembled condition.
Figure 3:
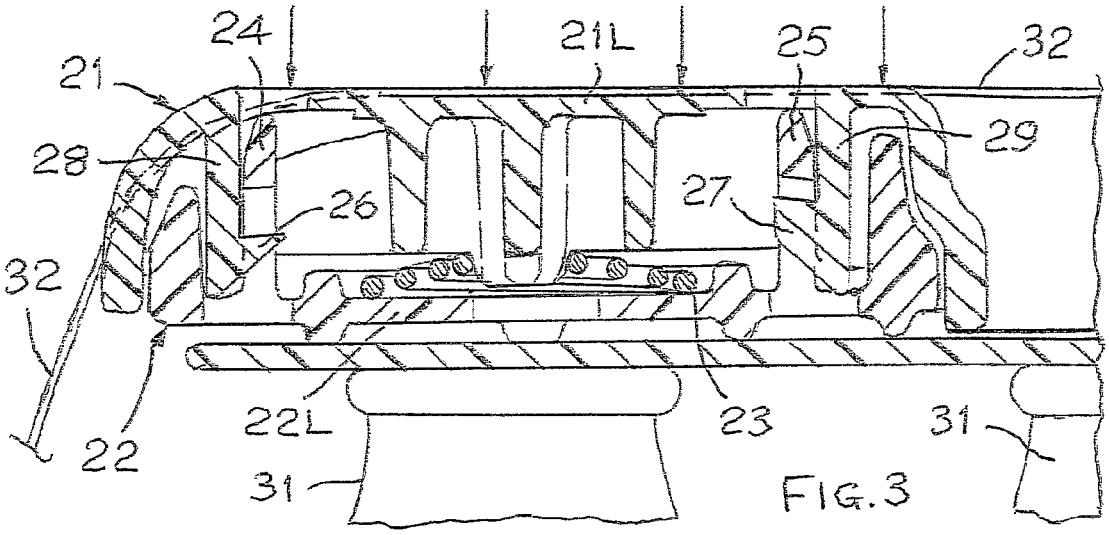
Figure 4:
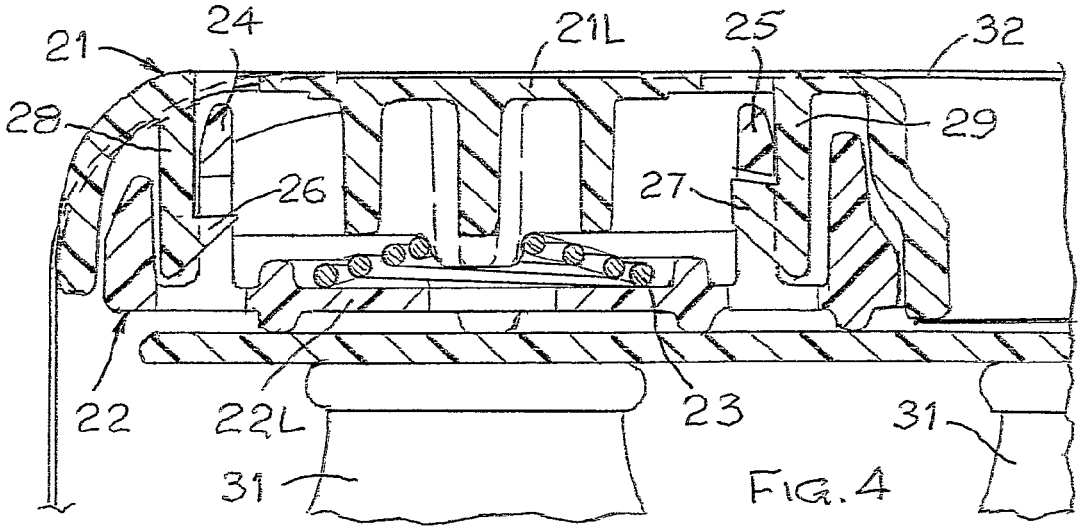
Figure 5:
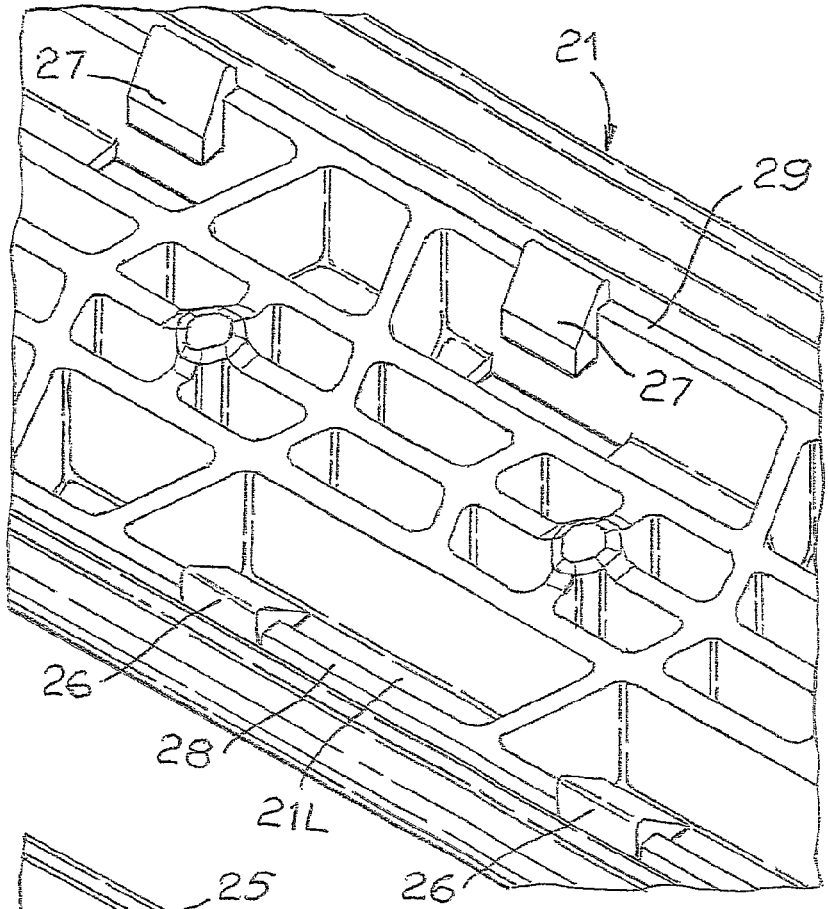
Figure 6:
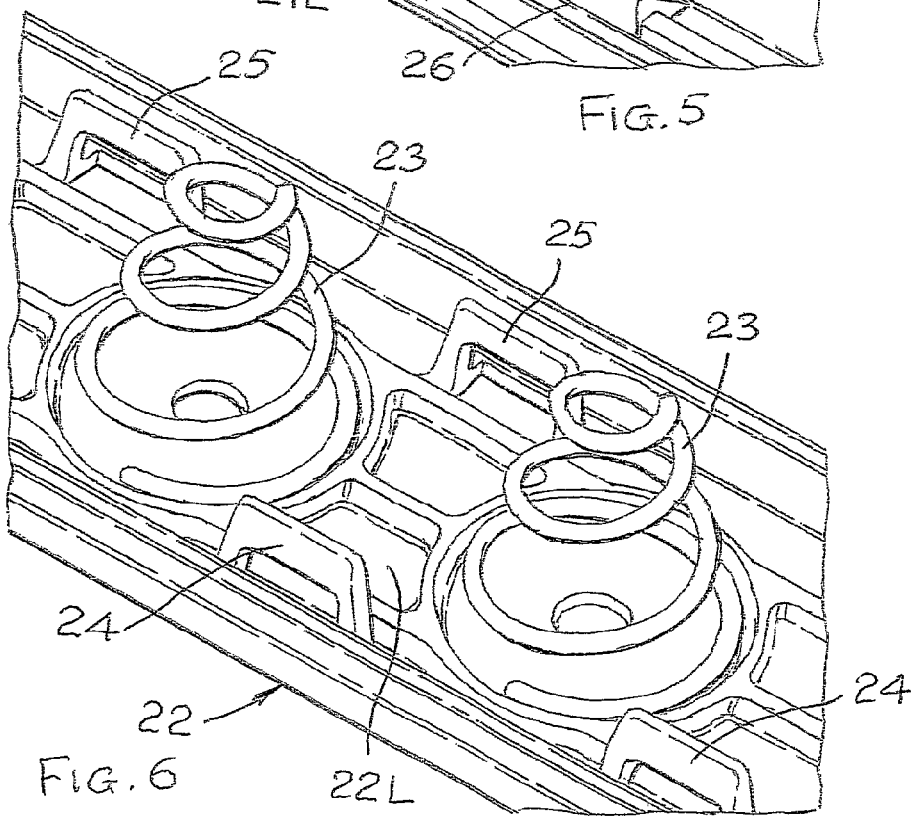

FIG. 3 corresponds to FIG. 2 but shows the device on top of a slip sheet on the top layer of bottles in a stack with downward loading applied during application of vertical strapping;

FIG. 4 corresponds to FIG. 2 but shows the condition of the device after completion of the application of vertical strapping and downward loading having been removed;

FIG. 5 is an isometric view of a portion of the upper frame (or leaf) shown inverted; and FIG. 6 is an isometric view of a corresponding portion of the lower frame (or leaf).

Figure 7:
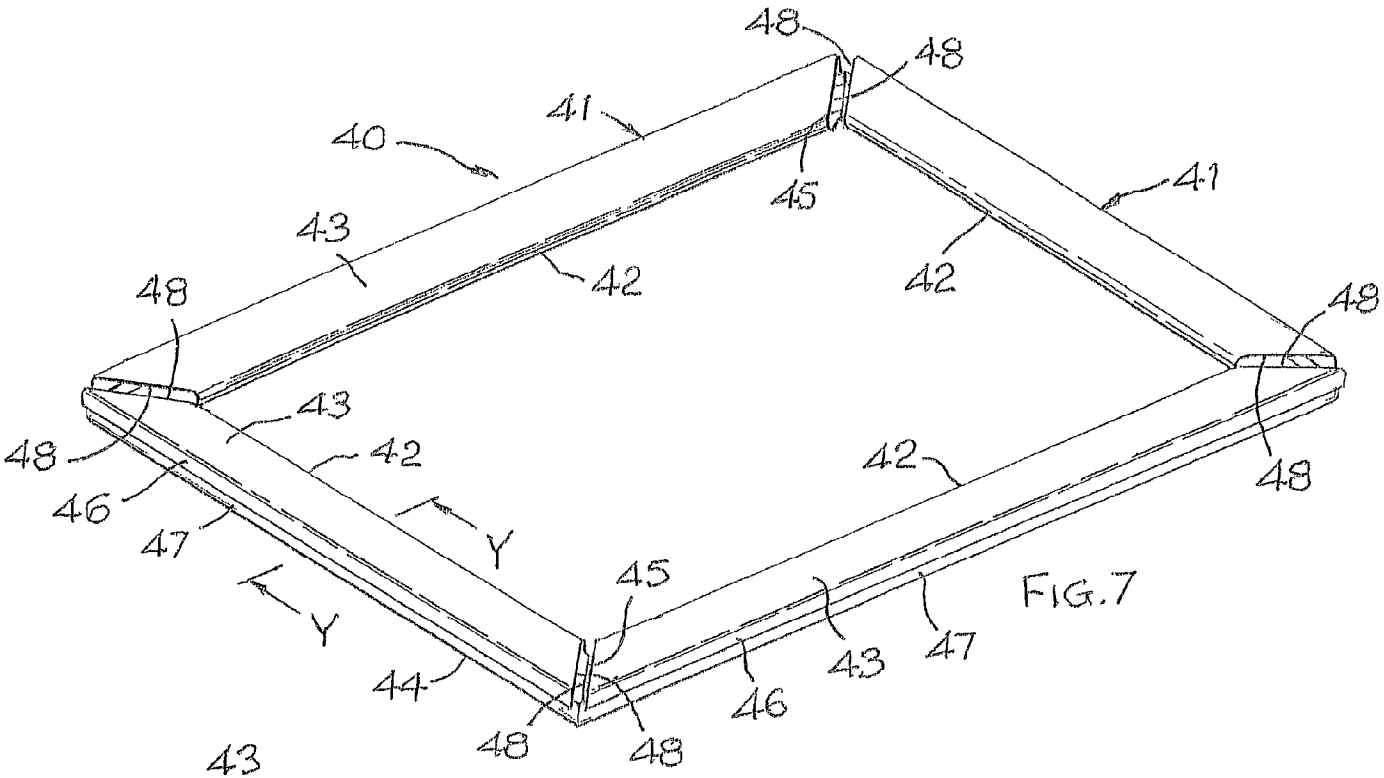
Figure 8:
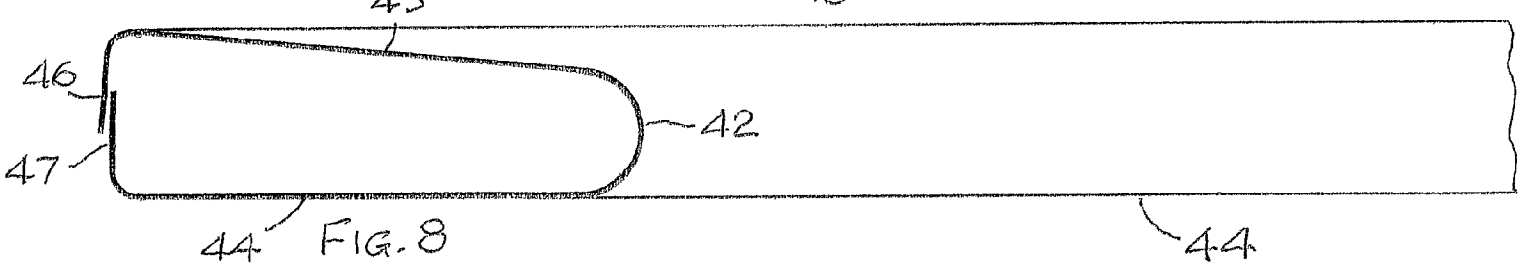
Figure 9:
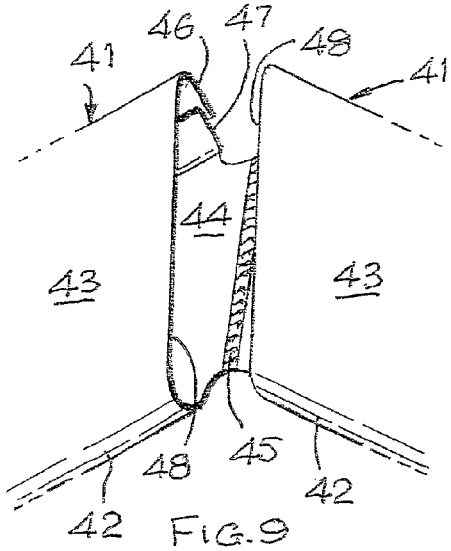
Figure 10:
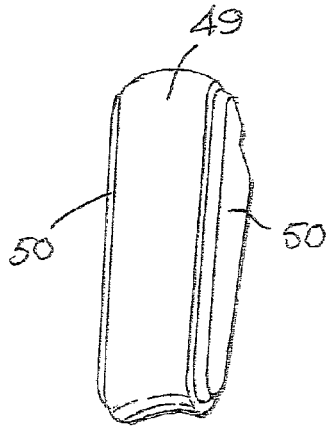

FIG. 7 is a small scale isometric view of another embodiment of the invention;

FIG. 8 is an enlarged vertical section on the line Y-Y of FIG. 7;

FIG. 9 is a fragmentary view of the upper corner of the device of FIG. 7 on a larger scale;

FIG. 10 shows a resilient plug for fitting in the corner of FIG. 9; and

Figure 11:
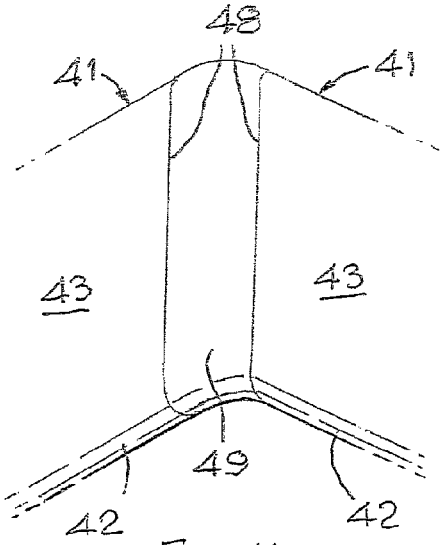

FIG. 11 shows the plug of FIG. 10 in place in the corner of FIG. 9.

Figure 12:
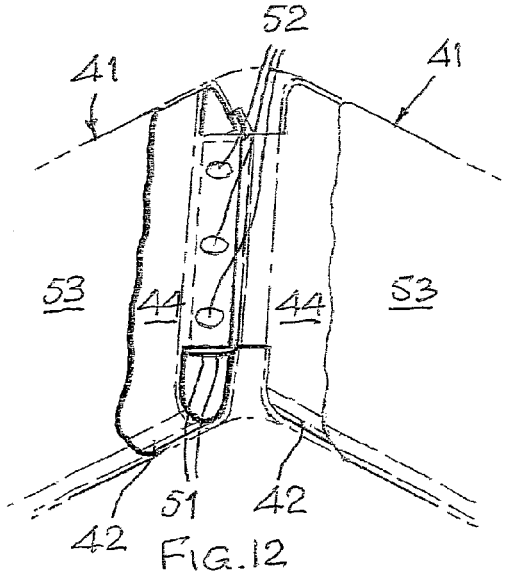

FIG. 12 is a fragmentary view of the underside of a corner similar to that in FIG. 9, but illustrating an alternative connection between the lower leaves of the device and indicating plastics coatings on the device.

Figure 14:
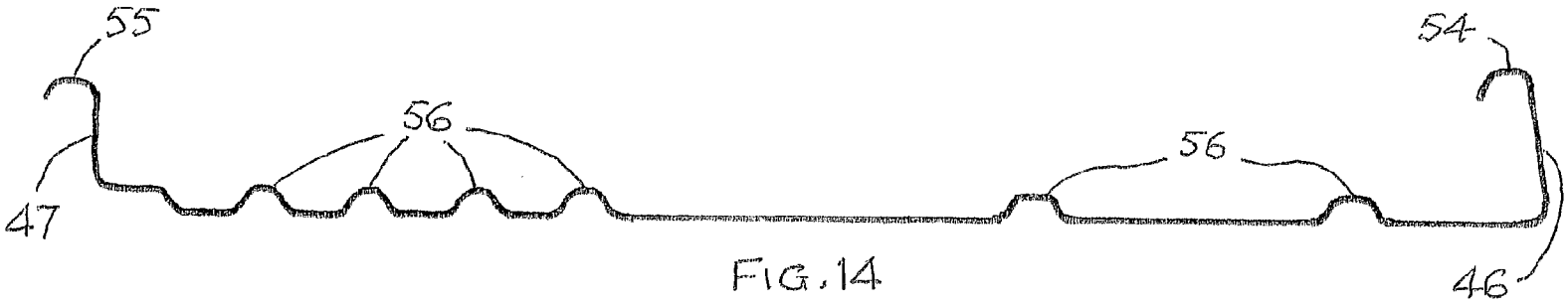
Figure 13:
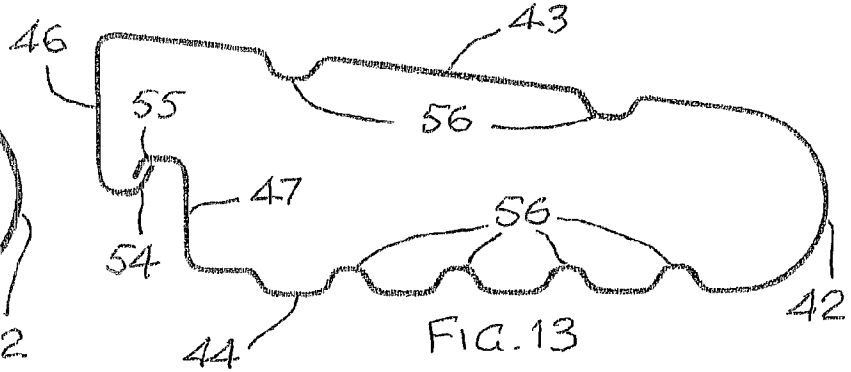
Figure 15:
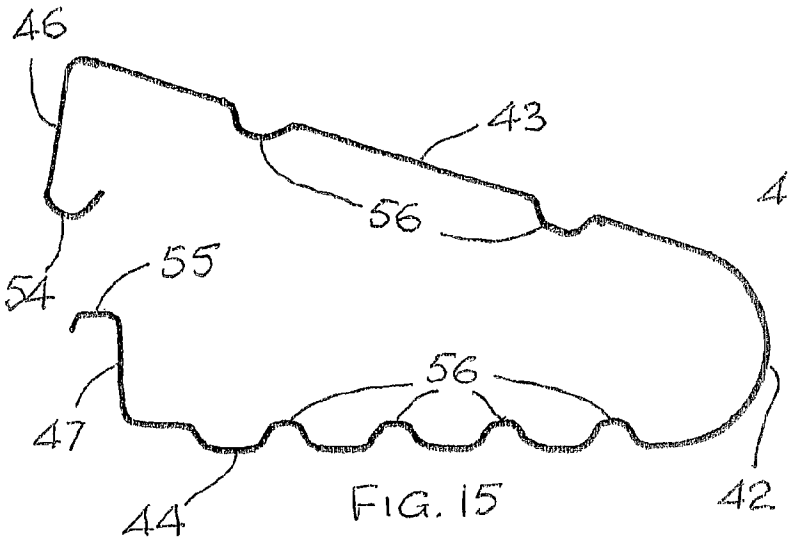

FIG. 13 corresponds to FIG. 8 but to a larger scale and showing tethering means along the overlapping outer edges of the leaves, as well as longitudinal stiffening corrugations;

FIG. 14 shows an initial stage in the formation of the device of FIG. 13; and FIG. 15 shows a further stage.

Figure 16:
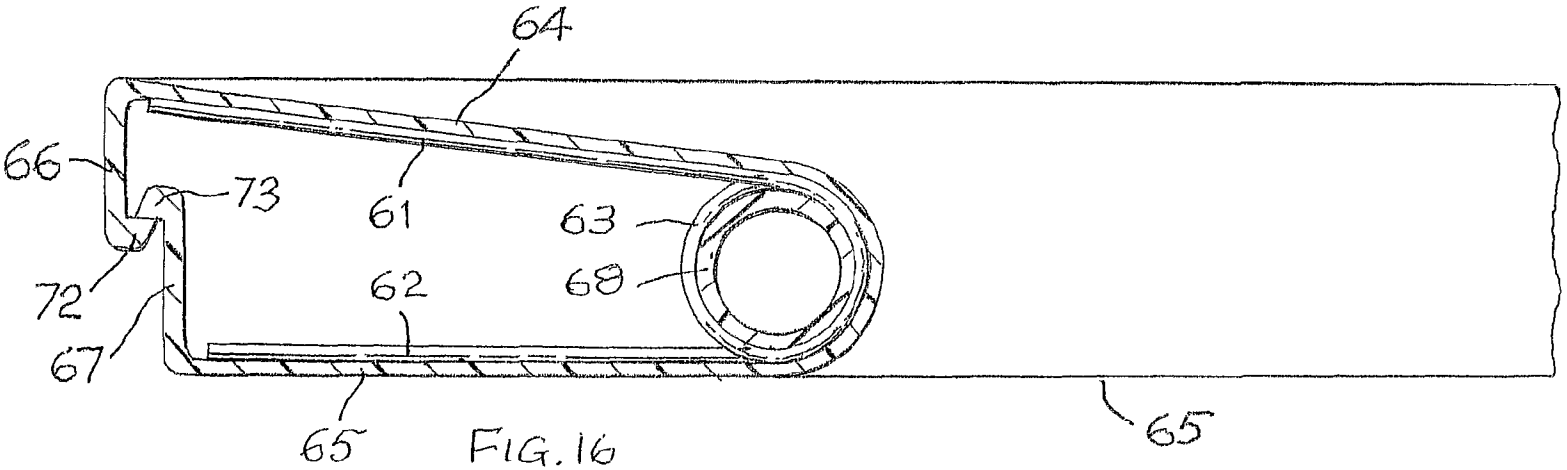
Figure 17:
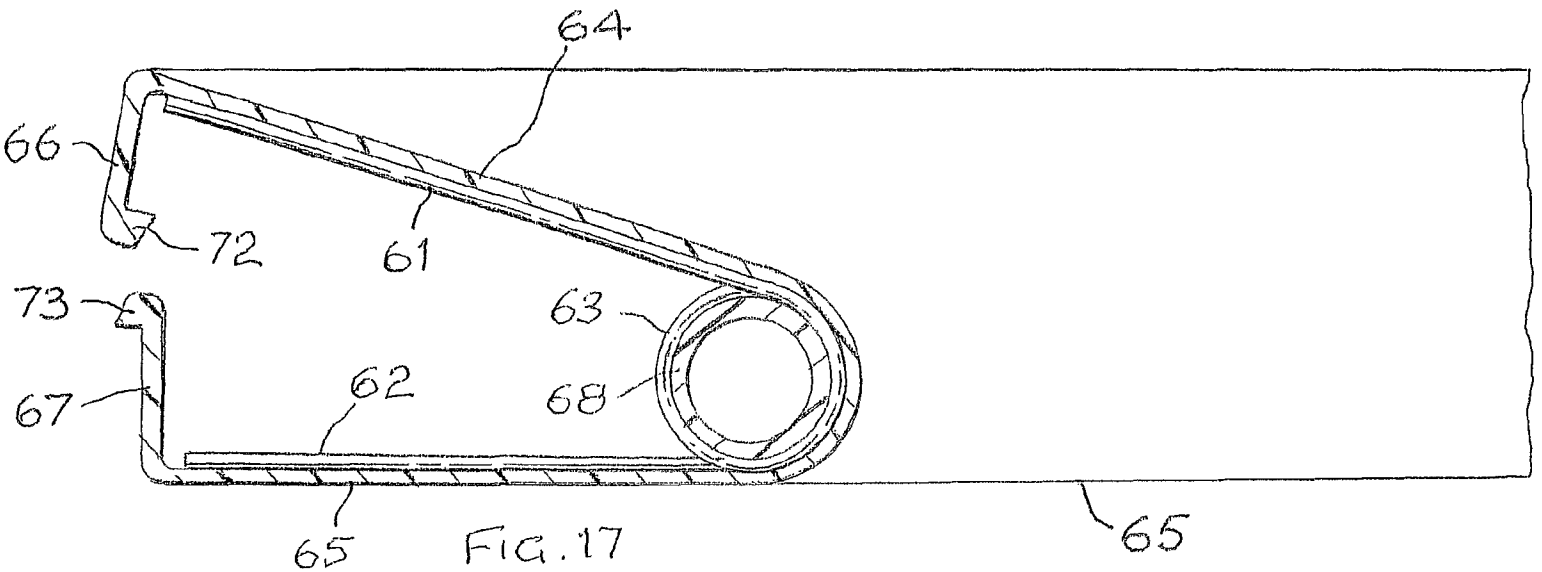
Figure 18:
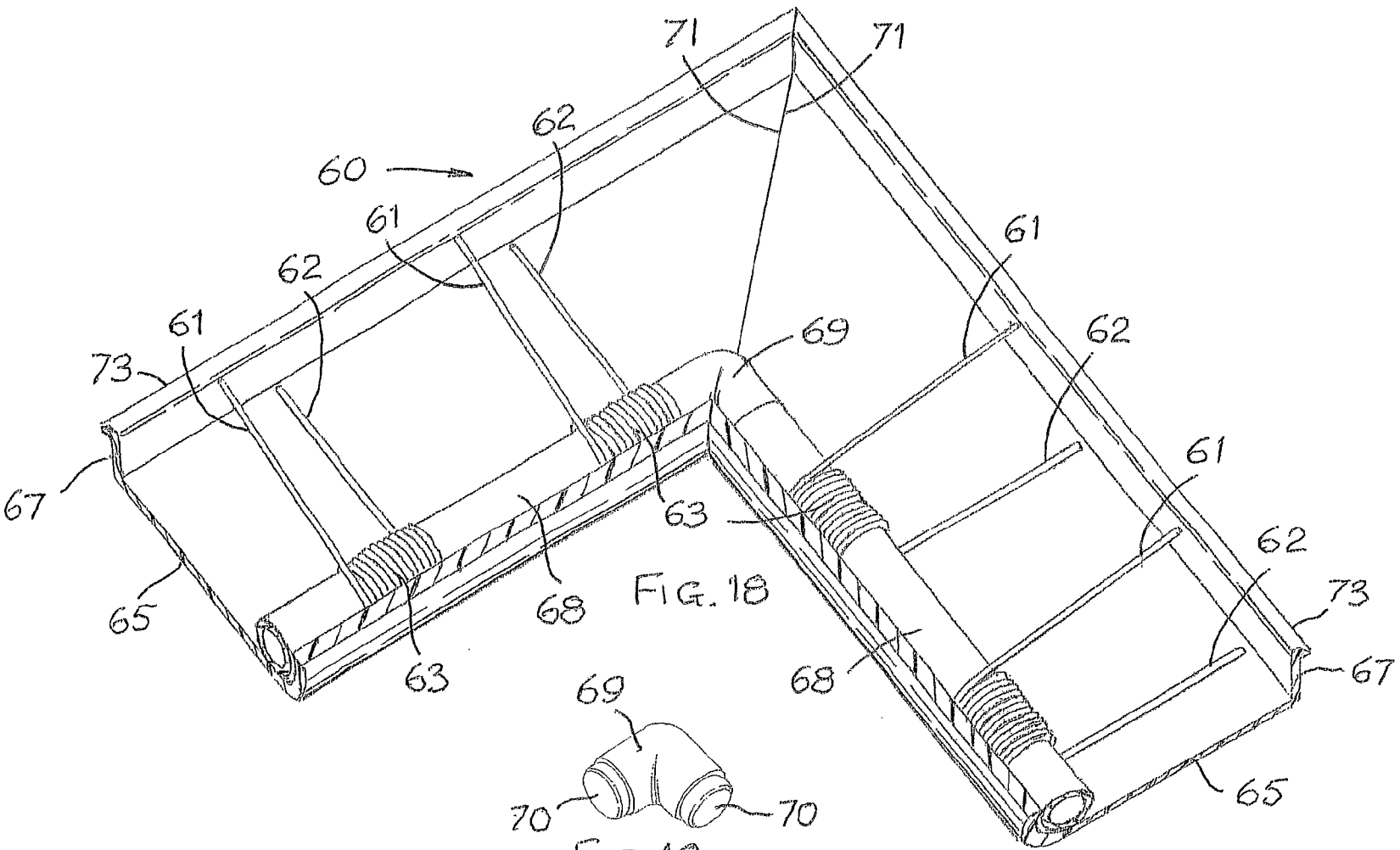
Figure 19:
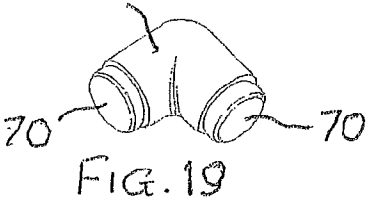

FIG. 16 corresponds to FIG. 13 but illustrates a device formed of plastics with separate spring means;

FIG. 17 corresponds to FIG. 16 but illustrates the device in its as-assembled condition;

FIG. 18 is a fragmentary isometric view of a corner of a device formed of plastics with separate spring means, with the upper leaf omitted; and FIG. 19 is an isometric view of a corner piece for connecting the tubes shown locating the spring means in FIGS. 16 to 18.

In FIGS. 1 to 6, the device 20 is basically similar in construction to the device described with reference to FIGS. 4 to 10 in GB-A-2 418 663, comprising upper and lower rectangular frames 21, 22, respectively, with a plurality of conical coil compression springs 23 between them urging them apart, and tethering means limiting separation of the frames and consisting of, on the one hand, the crossbars of goalpost-like upstanding formations 24, 25 in outer and inner rows respectively along each side or leaf 22L of the lower frame 22 (as particularly shown by FIG. 6) and, on the other hand, claws 26, 27 in outer and inner rows respectively along each side or leaf 21L of the upper frame 21 (as particularly shown by FIG. 5) for snap engagement with the formations 24, 25 respectively (as shown in FIG. 2) to effect pre-compression of the springs 23.

The leaves 22L of all four sides of the lower frame 22 are disposed in a common plane, and the claws 26, 27 are integral with longitudinal ribs 28, 29 respectively on the underside of the upper leaves 21L, the inner claws 27 having greater depth than the claws 26 so that, in the as-assembled condition shown in FIG. 2, the formations 25 and the claws 27 engaged therewith constitute a hinge between the inner sides of each pair of leaves 21L, 22L of the frames 21, 22, from which hinge the frames diverge towards their outer sides.

This modification of the device of GB-A-2 418 663 has a surprising advantageous effect that, after the device 20 has been placed on top of a slip sheet (or layer pad) 30 on the top of bottles 31 in the top layer of a stack on a pallet or dolly (not shown, but reference is made to FIGS. 1 to 3 of GB-A-2 418 663) and strapping 32 applied whilst the device 20 is subjected to downward loading, as indicated by the vertical arrows in FIG. 3, when the strapping has been secured and the downward loading removed, the bottles in the outer rows in the layers in the stack are held even more securely than is the case with the device as in GB-A-2 418 663.

As indicated in FIG. 4, there may be slight separation between the claws 27 and the crossbars of the formations 25, but when this is closed upon slackening of the strapping 32, the leaves 21L, 22L are urged to diverge about the reformed hinging by the springs 23, to the extent allowed by the appreciable gap between the claws 26 and the crossbars of the formations 24, to maintain tension in the strapping 32.

The device 40 shown in FIGS. 7 to 9 of simpler construction, has each of its sides 41 formed from spring steel strip bent longitudinally to form hinge means 42 integral with spring means between upper and lower leaves 43, 44 respectively, with the lower leaves 44 in a common plane and welded together at 45 (see particularly FIG. 9) along mating mitred edges at the corners of the rectangle, and with outer edge portions 46, 47 of the leaves along each side of the rectangle bent towards each other into overlapping relationship (see particularly FIG. 8), to prevent ingress of debris preventing proper use of the device. A gap is preferably left between mitred edges 48 of the upper leaves 43 to prevent clashing of them when, with the device 40 in use in similar manner to that shown in FIGS. 2 to 4, the upper leaves 43 are deflected towards the lower leaves 44, through which gap the welding 45 can be effected, and the gap is preferably being filled by a resilient plug 49 (see FIGS. 10 and 11) having spigots 50 to locate inside the mitred ends of the sides 41.

Alternative means for fixing the sides 41 together is illustrated by FIG. 12 in which overlapping tabs 51 on the mitred ends of the lower leaves 44 are secured together by rivets 52, which taps protrude beyond plastics coatings 53 on the sides 41.

The device 40 does not include any tethering means, so no preloading of the hinge/spring means 42 can be effected. In contrast, a device made up with sides formed of spring steel strip as illustrated by the cross-section shown in FIG. 13 has tethering means consisting of snap-engaging hooked edges 54, 55 along the overlapping outer edge portions 46, 47 of the leaves 43, 44; and FIGS. 14 and 15 show earlier stages in the forming of the sides, starting with the rolling in of the hooked edges 54, 55 and lengthwise stiffening corrugations 56 and then bending of the edge portions 46, 47 out of the general plane of the strip, reaching the stage shown in FIG. 14, and then bending to form the hinge/spring means 42 with the hooked edges 54, 55 spaced from each other, to reach the stage shown in FIG. 15, preloading of the hinge/spring means being effected by snap-engagement of the hooked edges to reach the stage shown in FIG. 13.

The device 60 illustrated by FIGS. 16 to 19 has along each side separate spring means each consisting of upper and lower arms 61, 62 diverging from a coiled hinge portion 63 and is encased in plastics material forming upper and lower leaves 64, 65 with co-moulded outer edge portions 66, 67 extending towards each other, the spring means being assembled by spaced location of their hinge portions 63 along a plastics tube 68 adapted for integration in between the plastics leaves 64, 65, and a solid plastics elbow 69 is formed with spigots 70 (see FIG. 19) to fit in adjacent ends of tubes 68 at a corner where mitred ends 71 of the lower leaves 64 at least are adhesively bonded or welded (see FIG. 18). FIG. 17 shows the as-assembled condition, with co-moulded projections 72, 73 on the outer edge portions 66, 67 ready for snap-engagement as shown by FIG. 18 to form tethering means effecting preloading of the spring means.

The invention claimed is:

1. A device for maintaining tension in vertical strapping on palletised loads of containers, said device comprising a rectangle having outer dimensions commensurate with the dimensions of a pallet or dolly on which containers are to be stacked in layers, each side of the rectangle comprising upper and lower leaves diverging from hinge means at the inner edge of the side, the lower leaves of all four sides being disposed in a common plane, and spring means urging the outer edges of the upper and lower leaves apart.

2. A device as in claim 1, wherein the sides of a pair of rectangular frames constitute the upper and lower leaves, springs are provided between the frames to urge them apart, and tethering means is provided to limit separation of the frames, and wherein tethering means adjacent the inner edges of the frames limits separation to such an extent that the effect is to form the hinge means between the leaves, whereby the springs between the frames urge the outer edges of the frames apart to an extent limited by tethering means adjacent those edges.

3. A device as in claim 1, wherein the spring means is integral with the hinge means.

4. A device as in claim 3, wherein each of its sides is formed from spring steel strip bent longitudinally to form hinge means between upper and lower leaves, with the lower leaves in a common plane and welded or riveted together at the corners of the rectangle, and with outer edge portions of the leaves along each side of the rectangle bent towards each other into overlapping relationship, to prevent ingress of debris preventing proper use of the device.

5. A device as in claim 4, wherein a gap is left between mitred edges of the upper leaves at each corner to prevent clashing of them when the upper leaves are deflected towards the lower leaves, and through which gap the welding or riveting of the lower leaves can be effected.

6. A device as in claim 5, wherein each corner is provided with a resilient plug to fill the gap.

7. A device as in any one of claims 4 to 6, wherein tethering means is provided between the outer edge portions of the leaves to enable pre-loading of the spring means, affording greater effectiveness in maintaining tension in vertical strapping of a load on a pallet.

8. A device as in claim 7, wherein the extreme edges of the overlapping outer edge portions are bent so as to hook together.

9. A device as in claim 3, wherein the leaves are coated with plastics material.

10. A device as in claim 1, wherein separate spring means each consisting of upper and lower arms diverging from an arcuate or coiled hinge portion are encased in plastics material forming upper and lower leaves with co-moulded outer edge portions extending towards each other into overlapping relationship, to prevent ingress of debris preventing proper use of the device, all the lower leaves of plastics material being in a common plane and connected together at the corners of the rectangle.

11. A device as in claim 10, wherein a plurality of spring means is assembled by spaced location of their hinge portions along a plastics rod or tube adapted for integration in between the plastics leaves.

12. A device as in claim 11, wherein the ends of the rods or tubes are connected together by sockets or spigots on corner pieces.

13. A device as in any one of claims 10 to 12, wherein tethering means is provided in the form of snap-engaging projections along the overlapping outer edge portions of the plastics leaves.

* * * * *